US007677759B1

(12) United States Patent
Leung

(10) Patent No.: US 7,677,759 B1
(45) Date of Patent: Mar. 16, 2010

(54) LED FLASHLIGHT LANTERN

(75) Inventor: Chung-Sum Frederick Leung, New Territories (CN)

(73) Assignee: Create Limited, Tsuen Wan, N.T., Hong Kong (CN)

( * ) Notice: Subject to any disclaimer, the term of this patent is extended or adjusted under 35 U.S.C. 154(b) by 0 days.

(21) Appl. No.: 12/313,771

(22) Filed: Nov. 24, 2008

(51) Int. Cl.
*F21V 21/14* (2006.01)

(52) U.S. Cl. ..... 362/232; 362/287; 362/199; 362/197; 362/269; 362/285

(58) Field of Classification Search ..... 362/199, 362/232, 287, 197, 269, 285
See application file for complete search history.

(56) References Cited

U.S. PATENT DOCUMENTS 5,530,633 A * 6/1996 Yuen ..... 362/184
5,607,217 A * 3/1997 Hobbs, II ..... 362/35
5,993,022 A * 11/1999 Neyer et al. ..... 362/199
6,024,054 A * 2/2000 Matt et al. ..... 119/796
6,744,693 B2 * 6/2004 Brockmann et al. ..... 362/321
7,524,079 B2 * 4/2009 Greenhoe ..... 362/183

* cited by examiner

*Primary Examiner*—Anabel M Ton
(74) *Attorney, Agent, or Firm*—Alix, Yale & Ristas, LLP

(57) ABSTRACT

A combination flashlight and lantern includes a body having a first axis, an internally reflective flashlight cup surrounding the first axis and a lens covering the cup. An externally reflective cone surrounds the first axis and has an apex through which the first axis passes. A drum is located between the cup and cone and pivots about a second axis that is normal to the first axis. An LED is mounted to the drum and directed radially from the second axis such that in a first orientation of the drum, the LED directed toward the apex of the cone and in a second orientation of the drum, the LED is directed at the lens. In a third orientation of the drum, the LED is directed perpendicularly to the first axis toward the shroud.

14 Claims, 4 Drawing Sheets

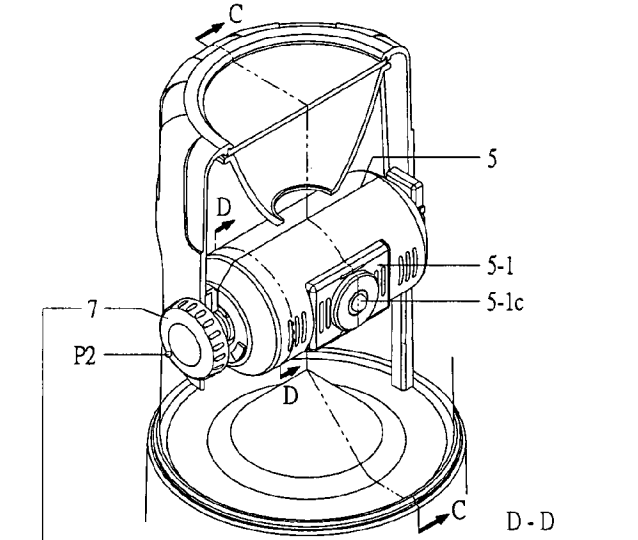
Fig. 7
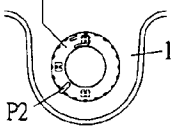
Fig. 8
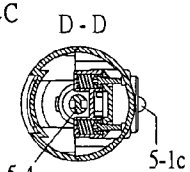
Fig. 9
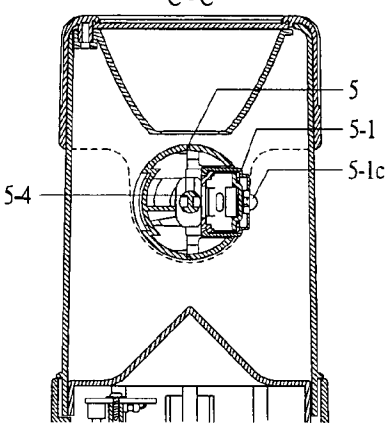
Fig. 10
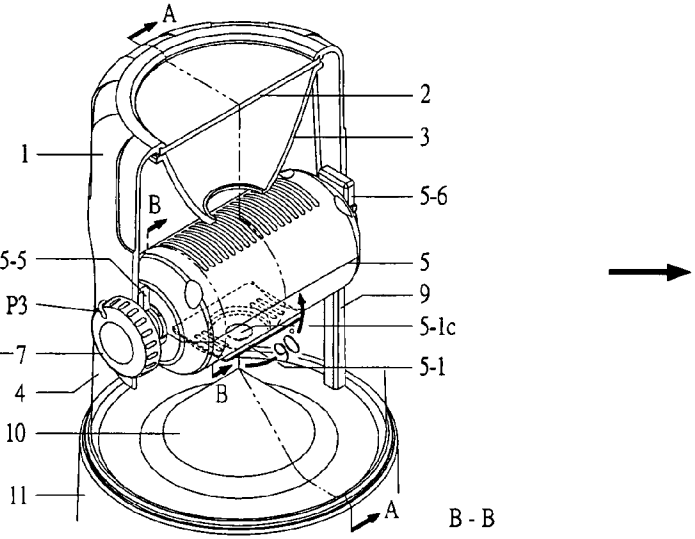
Fig. 3
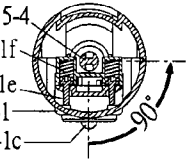
Fig. 4
Fig. 5
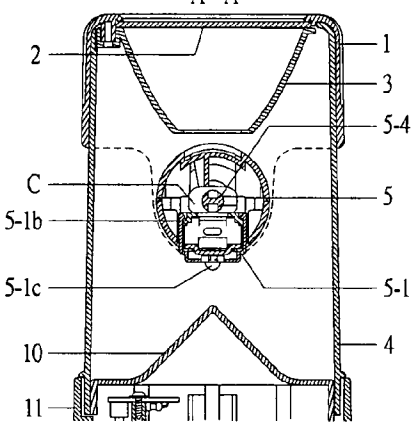
Fig. 6

E - E
F - F
G - G
H - H
I - I
J - J
90°
180°
5-1c
5-1
5-2
5-1e
5-1f
5-4
5-1b
C

LED FLASHLIGHT LANTERN

BACKGROUND OF THE INVENTION

The present invention relates to flashlights and lanterns. The invention more particularly, although not exclusively, relates to a device that can be used in one configuration as a flashlight, and in another configuration as a lantern.

It is known to employ high-efficiency LEDs in hand-held "torches" or flashlights. Some such flashlights comprise a multitude of high-efficiency LEDs.

Hand-held lanterns are of course also known and these can also comprise high-efficiency LEDs.

Very high-efficiency LEDs throw off a relatively high-intensity light beam but are expensive. A hand-held flashlight or hand-held lantern employing a very high-efficiency LED have much of their overall cost invested in the LED itself. A hand-held torch and lantern combination employing two very high-efficiency LEDs—one for the flashlight and another for the lantern—might not be economically viable as a manufactured article in a competitive market due to the duplicated LED costs involved.

SUMMARY

A cost-effective hand-held combination flashlight and lantern is provided.

There is disclosed herein a combination flashlight and lantern, comprising:

a body having a first axis, an internally reflective flashlight cup surrounding the first axis, a lens covering the cup, an externally reflective cone surrounding the first axis and having an apex through which the first axis passes, a drum located between the cup and cone and adapted to pivot about a second axis that is normal to the first axis, an LED mounted to the drum and directed radially from the second axis such that in a first orientation of the drum, the LED is upon the first axis and directed toward the apex of the cone and in a second orientation of the drum, the LED is upon the first axis and directed at the lens.

Preferably, the combination further comprises a carriage within the drum and to which the LED is mounted, the carriage adapted to move linearly within the drum such that in the second orientation of the drum, the LED can move along the first axis into the cup.

Preferably, the combination further comprises a knob attached to the drum and by which the drum is pivoted about the second axis. Preferably, the combination further comprises a cam attached to the knob and bearing against the carriage to cause said linear movement.

Preferably, the cam pivots in unison with the drum throughout pivotal movement of the drum and pivots relative to the drum when the LED is at said second orientation.

Preferably, the drum includes ventilation apertures.

Preferably, the combination further comprises a light-transmissive shroud surrounding the cone and through which light from the LED reflected by the cone passes.

Preferably, in a third orientation of the drum between the first and second orientations, the LED is directed perpendicularly to the first axis toward the shroud.

BRIEF DESCRIPTION OF THE DRAWINGS

A preferred form will now be described by way of example with reference to the accompanying drawings, wherein:

FIG. 3 is a schematic perspective cutaway illustration of the light with the drum rotated into a first orientation in which its LED is pointed down;

FIG. 4 is a schematic elevation of the drum rotation knob in the orientation of FIG. 3;

FIG. 5 is a schematic cross-sectional elevation of the drum in the orientation shown in FIG. 3;

FIG. 6 is a schematic cross-sectional elevation of the light in the drum orientation of FIG. 3;

FIG. 7 is a schematic perspective cutaway illustration of the light with the drum partially rotated and in an orientation in which the light can be used as a beacon;

FIG. 8 is a schematic elevation of the drum rotation knob in the orientation of FIG. 7;

FIG. 9 is a schematic cross-sectional elevation of the drum in the orientation shown in FIG. 7;

FIG. 10 is a schematic cross-sectional elevation of the light in the drum orientation of FIG. 7;

DESCRIPTION OF THE PREFERRED EMBODIMENT

Figure 1:
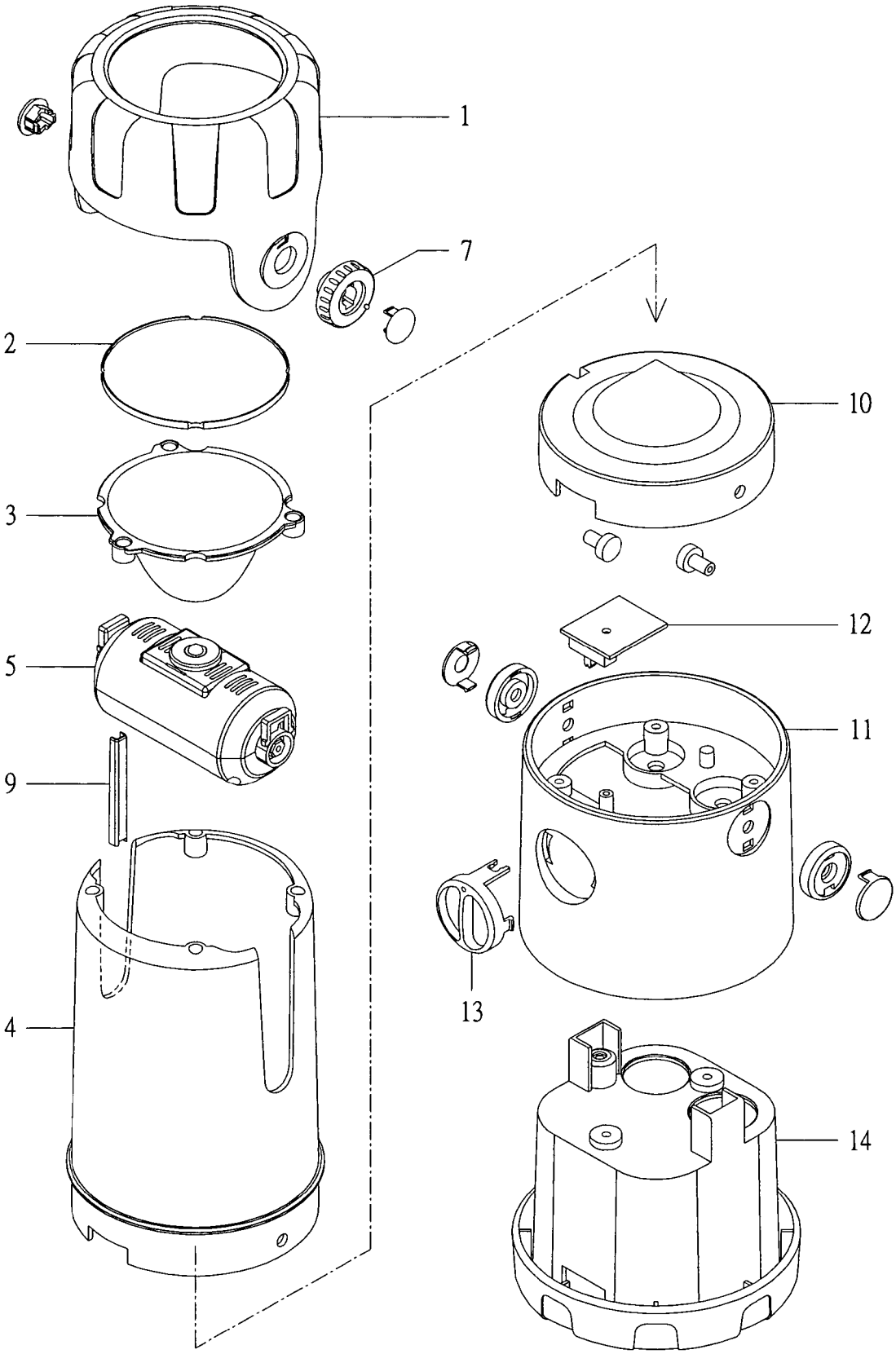
FIG. 1 is a schematic parts-exploded perspective illustration of a combination flashlight/lantern (hereinafter "light")

In the accompanying drawings there is depicted schematically a combination flashlight/lantern ("light") which comprises parts predominantly made of moulded plastics material. The light includes a base 14 which serves as a battery compartment and upon/about which there is fitted a pedestal 11. A switch activator 13 is fitted into an aperture of the pedestal 11 which co-operates with an electrical switch 12 to close a circuit between a battery housed within the battery compartment 14 and a high-intensity LED to be described later.

Fitted upon the pedestal 11 is an externally reflective cone 10 having its apex pointing up. Surrounding the cone 10 is a transparent (or otherwise light-transmissive) shroud 4.

A bezel 1 is fitted upon the shroud 4 and surrounds a lens 2 behind which there is situated an internally reflective parabolic cup 3.

Figure 2:
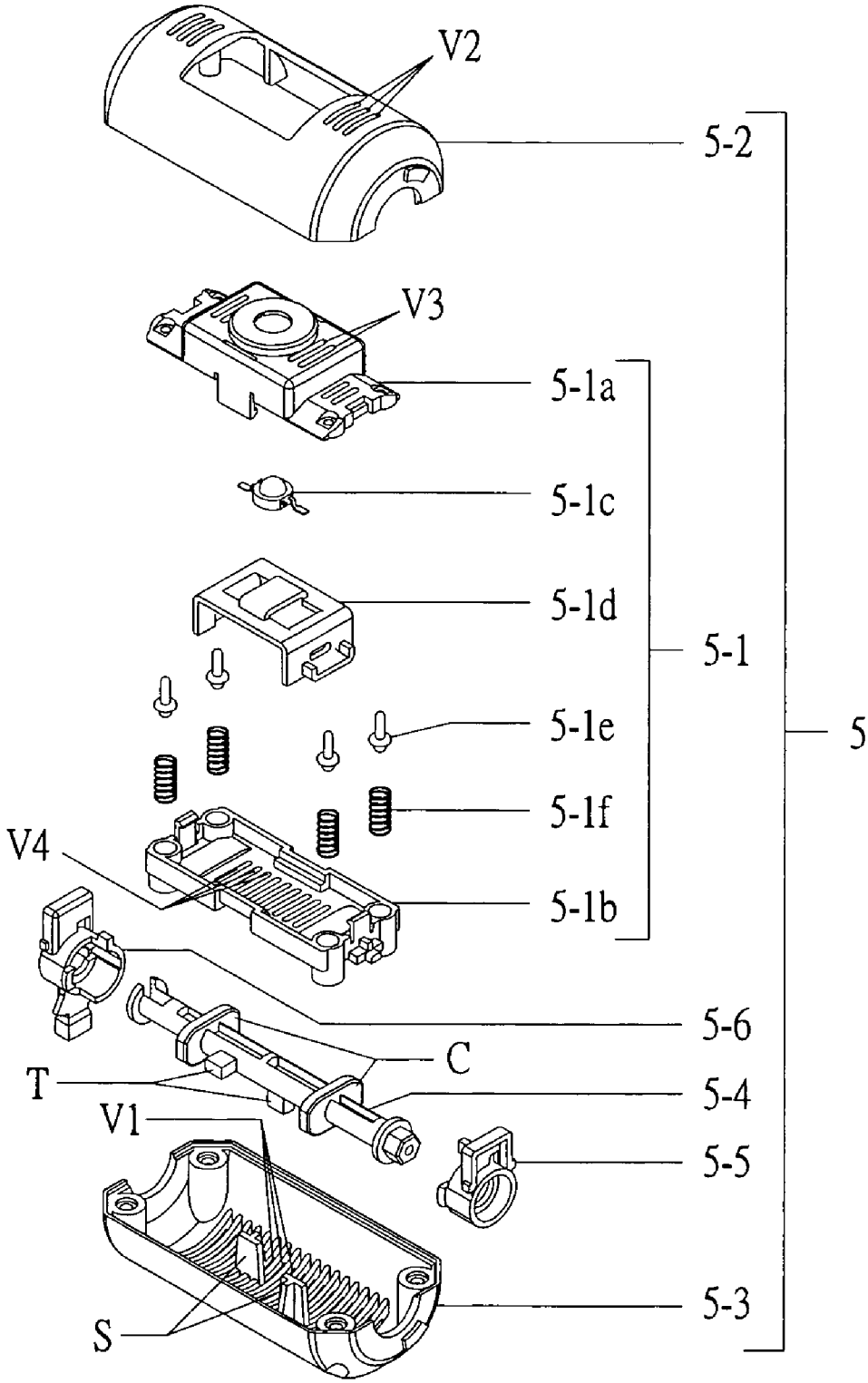
FIG. 2 is a schematic parts-exploded perspective illustration of a drum forming part of the light of FIG. 1.

Beneath the cup 3 and located within the shroud 4 is a drum 5 to which there is fitted a high-intensity LED 5-1*c* (FIG. 2). This drum is adapted to pivot throughout 180° about an axis which is normal to and crosses the major longitudinal axis of the light.

Power from batteries in the battery compartment 14 is relayed via wires (not shown) to the drum (for powering the LED) and a strip 9 having a wire-receiving groove serves to cover the wires to keep them tidy.

A knob 7 is attached to the drum 5 via an aperture in the bezel 1 and provides a means by which the drum can be pivotally rotated by a user. A positional marker (showing "P1", "P2", "P3" for example) is provided on the knob 7.

The drum 5 includes an upper moulding 5-2 having ventilation apertures V2. A carriage 5-1 is housed beneath the upper moulding 5-2 and has an upper moulding part 5-1*a* having ventilation apertures V3 at either side of an LED aperture through which the domed lens of a high-intensity LED 5-1*c* extends. The carriage also includes a lower part 5-1*b* with ventilation apertures V4 and which is snap-engaged with the upper part. The LED 5-1*c* is mounted upon a plate 5-1*d* which in turn rests upon the lower carriage part 5-1*b*. Four coil springs 5-1*f* fit into respective apertures formed in the lower carriage part 5-1*b* and spring buffer pins 5-1*e* are associated with each spring.

A transverse shaft 5-4 (to which the knob 7 is attached) extends through the drum 5 beneath the lower carriage part 5-1*b* and includes a pair of cams C which a bear upon the lower carriage part 5-1*b*. Bushings 5-5 and 5-6 serve to rotatably support the shaft 5-4.

During rotation of the drum 5 upon user-manipulation of knob 7, the shaft 5-4 does not affect radial movement of the carriage 5-1. However, when the drum comes to a rotational stop point, further rotation of the knob 7 causes the cams C to bear against the lower carriage part 5-1*b* so that the carriage moves outwardly against the force of springs 5-1*f*. Moreover, throughout rotation of the drum from its orientation as depicted in FIG. 3 past the orientation depicted in FIG. 7 to the orientation depicted in FIG. 15, the carriage 5-1 remains retracted. Further rotation of the knob 7 causes interaction of the cams C with the carriage so that radial movement of the carriage causes the domed head of LED 5-1*c* to extend into the parabolic reflector 3 as shown in FIG. 19.

The lower moulding part 5-3 of the drum has ventilation apertures V1 and inwardly and upwardly extending stoppers S against each of which one of a respective pair of 90° offset radial tabs T of the shaft 5-4 abut to define the aforementioned pivotal set point.

Figures 11, 12, 13, 14, 15, 16, 17, 18, 19, 20, 21, 22:
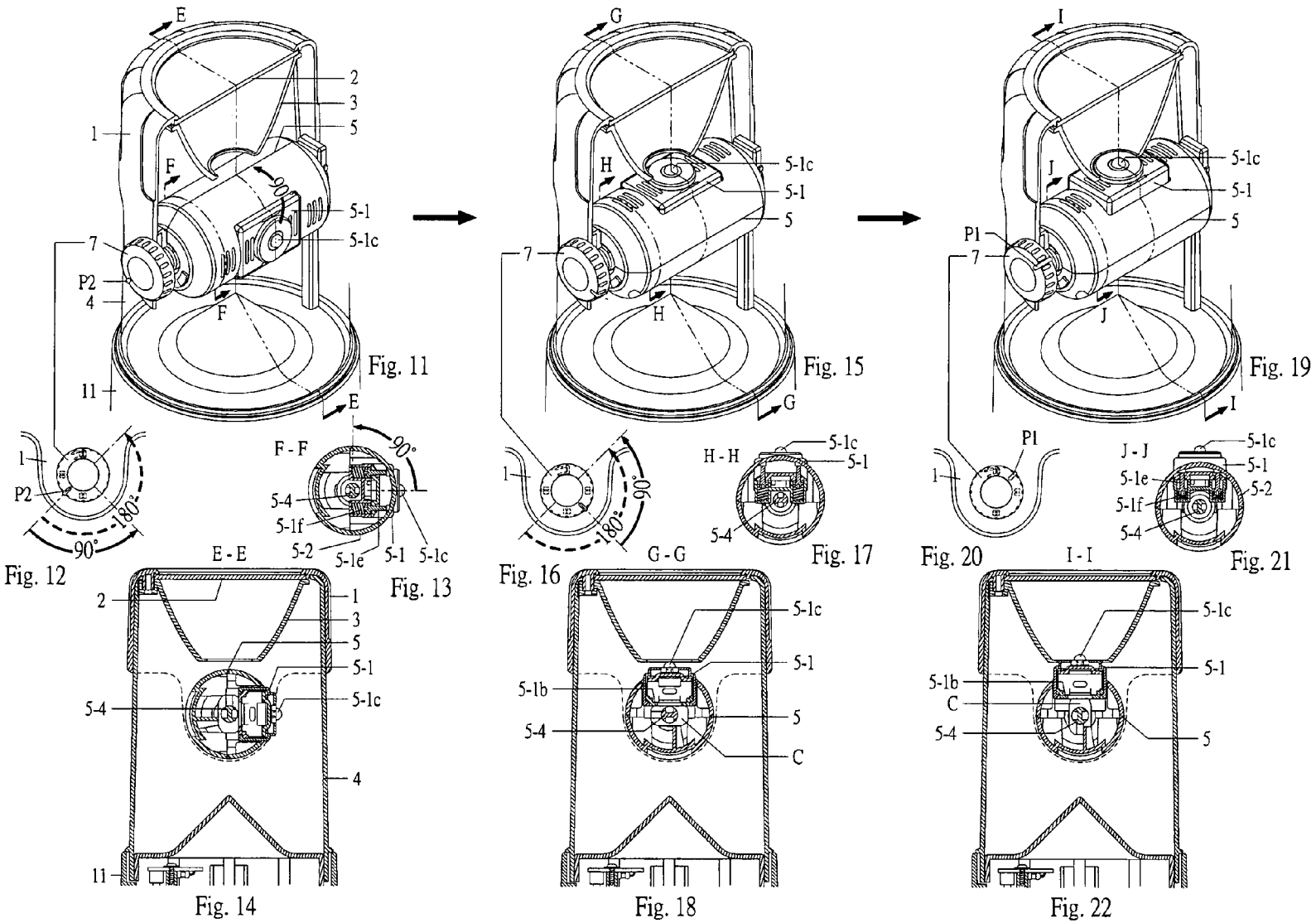
FIGS. 11 to 14 repeat FIGS. 7 to 10.
FIG. 15 is a schematic perspective cutaway illustration of the light with the drum rotated into a second orientation in which its LED is pointed up.
FIG. 16 is a schematic elevation of the drum rotation knob in the orientation of FIG. 15.
FIG. 17 is a schematic cross-sectional elevation of the drum in the orientation shown in FIG. 15.
FIG. 18 is a schematic cross-sectional elevation of the light in the drum orientation of FIG. 15.
FIG. 19 is a schematic perspective cutaway illustration of the light with the drum in the second orientation in which its LED is pointed up and also extended into the flashlight reflector cup.
FIG. 20 is a schematic elevation of the drum rotation knob in the orientation of FIG. 19.
FIG. 21 is a schematic cross-sectional elevation of the drum extended as shown in FIG. 19.
FIG. 22 is a schematic cross-sectional elevation of the light in the LED-extended configuration of FIG. 19.

Rotation of the knob in the opposite direction will allow retraction of the carriage position depicted in FIG. 19 to the position depicted in FIG. 15 from where further backward rotational the knob returns the drum to the orientation depicted in FIG. 3 whereat the LED points downwardly toward the apex of the reflective cone 10. This is the orientation of the drum at which the light is used as a lantern whereby light emitted by the LED is reflected by the cone and passes in all radial directions out through the light transmissive shroud 4.

At a third orientation of the drum as depicted in FIGS. 7, 10, 11 and 14, the light can be used as a beacon. Ordinarily, the drum pivots through the third orientation when moving between the first and second orientations. However, the drum can be left stationary at the third orientation such that the LED 5-1*c* is directed radially of or perpendicular to the longitudinal axis of the body. In this orientation the LED shines directly through the shroud 4.

It should be appreciated that modifications and alterations obvious to those skilled in the art are not to be considered as beyond the scope of the present invention. For example, rather than providing an extending/retracting carriage, a small cut-out could be provided in the base of the parabolic reflector cup 3 to enable a fixed/extended LED to pass laterally into the reflector cup.

The invention claimed is:

1. A combination flashlight and lantern, comprising:

a body having a first axis, an internally reflective flashlight cup surrounding the first axis, a lens covering the cup, an externally reflective cone surrounding the first axis and having an apex through which the first axis passes, a drum located between the cup and cone and adapted to pivot about a second axis that is normal to the first axis, an LED mounted to the drum and directed radially from the second axis such that in a first orientation of the drum, the LED is upon the first axis and directed toward the apex of the cone and in a second orientation of the drum, the LED is upon the first axis and directed at the lens; and a carriage within the drum and adapted to move linearly within the drum such that in the second orientation of the drum, the LED can move along the first axis into the cup.

2. The combination of claim 1, further comprising a knob attached to the drum and by which the drum is pivoted about the second axis.

3. The combination of claim 2, further comprising a cam attached to the knob and bearing against the carriage to cause said linear movement.

4. The combination of claim 3, wherein the cam pivots in unison with the drum throughout pivotal movement of the drum and pivots relative to the drum when the LED is at said second orientation.

5. The combination of claim 1, wherein the drum includes ventilation apertures.

6. The combination of claim 1, further comprising a light-transmissive shroud surrounding the cone and through which light from the LED reflected by the cone passes.

7. The combination of claim 6, wherein in a third orientation of the drum between the first and second orientations, the LED is directed perpendicularly to the first axis toward the shroud.

8. A combination flashlight and lantern, comprising:

a body having a first axis, an internally reflective flashlight cup surrounding the first axis, a lens covering the cup, an externally reflective cone surrounding the first axis and having an apex through which the first axis passes, a drum located between the cup and cone and adapted to pivot about a second axis that is normal to the first axis, an LED mounted to the drum and directed radially from the second axis such that in a first orientation of the drum, the LED is upon the first axis and directed toward the apex of the cone and in a second orientation of the drum, the LED is upon the first axis and directed at the lens, and a light transmissive shroud surrounding the cone and through which light from the LED reflected by the cone passes.

9. The combination flashlight/lantern of claim 8, further comprising a carriage within the drum and to which the LED is mounted, the carriage adapted to move linearly within the drum such that in the second orientation of the drum, the LED can move along the first axis into the cup.

10. The combination of claim 9, further comprising a knob attached to the drum and by which the drum is pivoted about the second axis.

11. The combination of claim 10, further comprising a cam attached to the knob and bearing against the carriage to cause said linear movement.

12. The combination of claim 11, wherein the cam pivots in unison with the drum throughout pivotal movement of the drum and pivots relative to the drum when the LED is at said second orientation.

13. The combination of claim 9, wherein the drum includes ventilation apertures.

14. The combination of claim 8, wherein in a third orientation of the drum between the first and second orientations, the LED is directed perpendicularly to the first axis toward the shroud.

* * * * *